United States Patent [19]

Majaniemi

[11] Patent Number: 4,482,430

[45] Date of Patent: Nov. 13, 1984

[54] EXTENDED NIP PRESS LUBRICATING SYSTEM FOR A PAPER MACHINE

[75] Inventor: Pekka Majaniemi, Pirkkala, Finland

[73] Assignee: OY. Tampella AB, Tampere, Finland

[21] Appl. No.: 475,174

[22] Filed: Mar. 14, 1983

[30] Foreign Application Priority Data

Apr. 1, 1982 [FI] Finland ..... 821140

[51] Int. Cl.[3] ..... D21F 3/02

[52] U.S. Cl. ..... 162/358; 100/118; 100/121; 100/153; 100/156; 162/205; 184/15.1; 198/500; 198/811

[58] Field of Search ..... 162/358, 205; 100/118, 100/121, 153, 156; 184/15.1, 16, 17; 198/811, 500

[56] References Cited

U.S. PATENT DOCUMENTS

| | | | |
|---|---|---|---|
| Re. 30,268 | 5/1980 | Justus | 162/358 X |
| 3,527,668 | 9/1970 | Kusters et al. | 100/121 X |
| 3,853,698 | 12/1974 | Mohr | 162/358 |
| 4,287,021 | 9/1981 | Justus et al. | 162/358 |

*Primary Examiner*—S. Leon Bashore
*Assistant Examiner*—K. M. Hastings
*Attorney, Agent, or Firm*—Ladas & Parry

[57] ABSTRACT

An extended nip press for a paper machine for removing water from a wet paper, cardboard or similar fibrous or porous web. The press comprises a rotating press roll and at least one stationary loading shoe as well as a band impermeable to a medium and movable between said press roll and loading shoe. The loading shoe is provided with a sliding surface against which the press roll is pressed through the band for forming an extended press zone. A paper web to be dried is passed through the press zone together with a felt for receiving water. The band is made compressible, and in its surface facing the sliding surface are formed a plurality of separated recesses into which a lubricating medium is sprayed. The band is compressed in the press zone under the action of the pressure force of the press roll, whereby the recesses are flattened and entirely closed, and their volume is reduced so that the lubricating medium is pressed in between the intermediate parts of the recesses and the sliding surface while producing a lubricating layer over the entire sliding surface. The press gap between the sliding surface and the press roll is tapered in a wedge shaped manner towards the outlet side of said sliding surface.

10 Claims, 12 Drawing Figures

Figure 3:
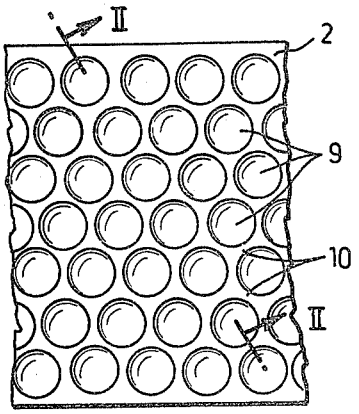

FIG. 1
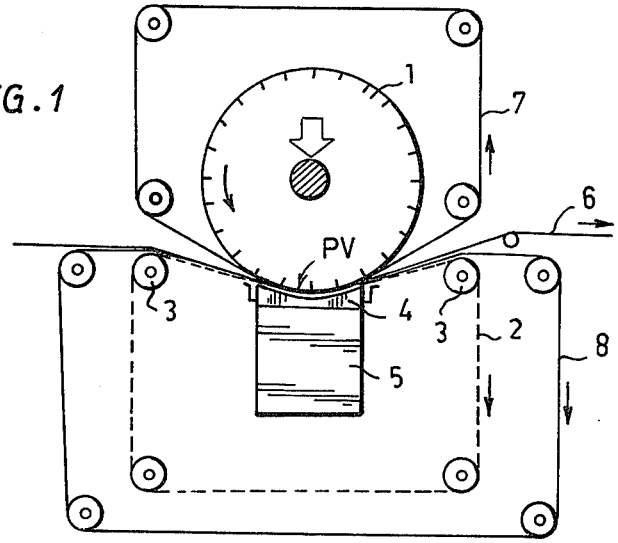
FIG. 2
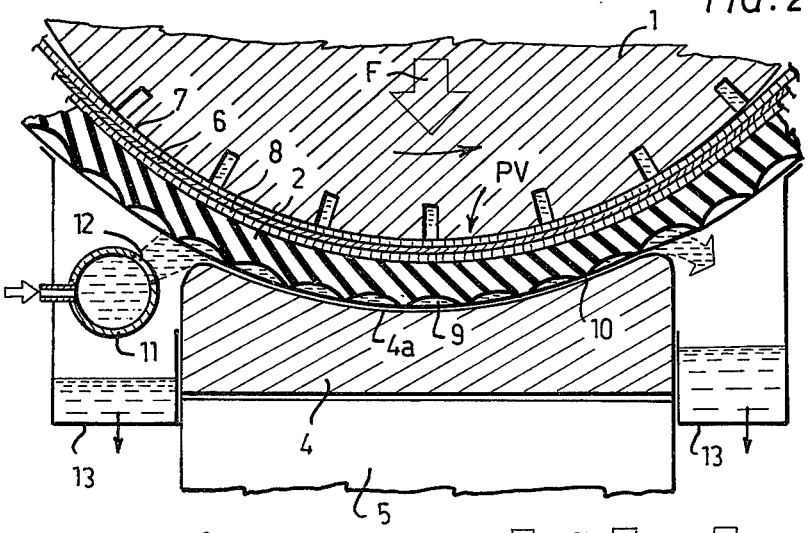
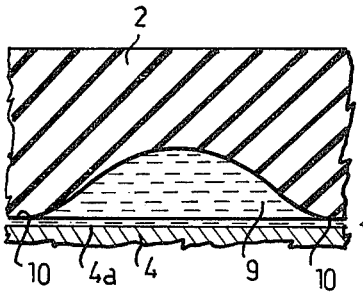
FIG. 5a
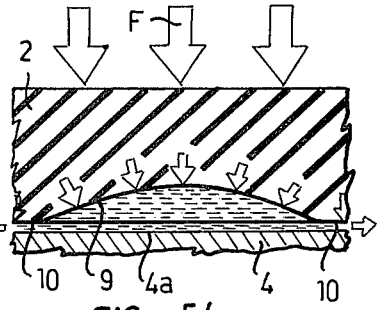
FIG. 5b

EXTENDED NIP PRESS LUBRICATING SYSTEM FOR A PAPER MACHINE

This invention relates to an extended nip press for a paper machine for removing water from a wet paper, cardboard or similar fibrous or porous web, said press comprising a rotating press roll, at least one stationary loading shoe which is parallel with the axis of the press roll and together with the press roll forms an extended press zone, a band which is impermeable to a medium and passes through the press zone between the press roll and the loading shoe, a sliding surface in the loading shoe which is pressed against the band from the opposite side with respect to the press roll, at least one drying felt passing through the press roll and the band for passing a web to be dried the press zone and for receiving water removed from the web, and means for introducing a lubricating medium in between the band and the sliding surface of the loading shoe.

It is earlier known to extend in a press for a paper machine the zone in which the web to be treated is pressed against the peripheral surface of a press roll so that the press zone extends over a substantial distance in the direction of the periphery of said roll. The aim is to keep the web in this way under pressure over a longer distance as the web passes through such an extended press nip so as to increase the water removal capacity of the press.

U.S. patent specification No. 3,853,698 discloses an extended nip press comprising a rotating press roll and an endless belt which is impermeable to pressure medium and is pressed against a portion of the peripheral surface of the press roll so as to form a curved press zone between the press roll and the band. The press is provided with a pressure box which is parallel with the press roll and forms a chamber which is open towards the band and into which pressure medium is introduced for pressing the band against the peripheral surface of the press roll in the area of the press zone.

However, such a press construction suffers from the disadvantage of a continuous leakage of pressure medium out of the chamber of the pressure box between the band and the sealing edges of said box pressed against said band because, in practice, it is impossible to make the construction completely tight due to the relative movement of the band and the pressure box. A further disadvantage is that the pressure medium must be maintained under a relatively high pressure whereby the pressure medium, while leaking, may splash over a wide surrounding area.

From U.S. patent specification No. Re 30,268 is previously known an extended nip press similarly comprising a press roll and a flexible band pressed against a portion of the peripheral surface of said roll. The press is provided with one or more loading shoes which are of the same length as the roll and are hydraulically pressed against the band. An extended press zone is formed on that area of the peripheral surface of the press roll in which the shoes load the band against the roll.

In order to lubricate the band sliding along the sliding surface of the shoe, a lubricant is fed to the front edge of the shoe which is shaped so as to form a lubricant wedge between the shoe and the band. To produce a lubricant layer over the entire length of the sliding surface requires that the shoe is properly shaped and supported at the proper point. These requirements are difficult to meet in the construction according to this patent. Because, in addition to the band, also the web to be dried and one or two press felts pass between the shoe and the roll, the radius of curvature of the shoe which, must be precisely dimensioned, will change as the thickness of the paper is changed and even more along with the age of the felt due to the compression of the structure of said belt. Therefore, it cannot be guaranteed that a sufficient lubricant layer is always formed between the band and the shoe. As a result, the band may be rapidly worn or damaged too early.

The object of this invention is to provide an extended nip press which eliminates the above-mentioned disadvantges and improves the lubrication conditions for a press operating according to the sliding shoe principle. This object is achieved by a press according to the invention which is characterized in that the band impermeable to pressure medium is compressible, and in that the surface of the band facing the sliding surface of the loading shoe is provided with recesses for the lubricating medium.

The invention is based on the idea of bringing the lubricating medium to the sliding surface of the loading shoe along with the compressible band which, as it is compressed in the press zone, gives off lubricating medium onto the sliding surface. The recesses formed in the surface of the band are filled with lubricating medium, preferably water, before the press zone. The gap betwen the press roll and the sliding surface of the loading shoe is most preferably made to taper in a wedge-shaped manner so that the band is gradually compressed as it advances through the press zone and uniformly gives off lubricating medium over the entire length of the sliding surface. As the band is compressed, the medium is pressed between the parts between the sliding surface and the recesses in the band. From the construction follows that variations in the thickness of the web and the felt in no way affect the pressure properties because the band is always compressed according to the nip between the surfce of the felt and the loading shoe and, accordingly, uniformly presses the press zone all the time.

Figure 4:
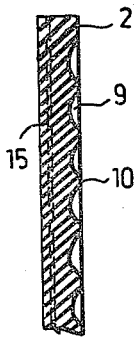
Figure 6:
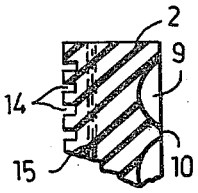

In the following the inventon will be described in more detail with reference to the accompanying drawings, in which FIG. 1 is a schematical general principle view of a press according to the invention, FIG. 2 is a vertical section of the press zone of the press on an enlarged scale, FIG. 3 illustrates on an enlarged scale the recessed surface of a band, FIG. 4 is a cross-section of the band, FIGS. 5*a* and 5*b* are vertical sections of the compression of a recess in the band, FIG. 6 is a cross-section of an alternative embodiment of the band, and FIGS. 7*a* to 7*e* illustrate alternative embodiments of the recessed surface of the band.

FIG. 1 in the drawings illustrates an extended nip press comprising a rotating press roll 1 and an endless band 2 which is impermeable to liquid and is by means of band guide rolls 3 guided so as to be pressed against a portion of the peripheral surface of the press roll.

The press further comprises a loading shoe 4 supported on a frame girder 5. The loading shoe is pressed against the band so that on this area of the periperal surface of the press roll is formed an extended press zone PV, in which the shoe loads the band.

A paper web to be dried is passed betwen an upper drying felt 7 and a lower drying felt 8 through the press zone between the press roll and the band for pressing water out of the wet web into the felts. In some cases, the number of felts may be only one.

The press roll or the loading shoe are loaded by means of external loading means (not shown) in order to produce a required pressure in the press zone. The surface of the press roll is preferably provided with a so-called blind bore or any other recessed surface, which increases the water removal capacity of the press.

The liquid-impermeable band 2 is made compressible so that the band is compressed in the press zone under the action of a force F applied by the press roll but is restored to its original condition when the force F has ceased to act after the press zone.

In the surfce of the band 2 facing the loading shoe are formed a plurality of cup-shaped recesses 9 separated by narrow (intermediate) parts 10. The recesses form a regular surface pattern covering the entire band from one edge to the other.

On the inlet side of the loading shoe is mounted a spray pipe 11 into which water is pumped for spraying the water through holes 12 towards the recesses in the band. Water collecting grooves 13 are mounted on each side of the shoe.

The gap between the press roll and the curved sliding surface 4*a* of the loading shoe 4 facing the band tapers towards the outlet end of the press zone.

During operation of the press, the band 2 is compressed in the press zone whereby the recesses are flattened in a corresponding manner. Because the gap between the press roll and the loading shoe diminishes in a wedge-shaped manner, the compression of the band is more forceful at the outlet end of the zone whereby the volume of the recesses is gradually reduced in the direction from the inlet end to the outlet end. For this reason, the water sprayed from the recesses is pressed underneath the parts 10 between said recesses and thereby serves as lubricant between the band and the sliding surface.

FIGS. 5*a* and 5*b* illustrate the compression of the recesses and the penetration of water in between the intermediate parts and the sliding surface. It will be noted that, by means of construction used, the water used as lubricating agent can be transferred over the entire area of the sliding surface and pressed in between the band and the sliding surface by means of the pressure produced by the press roll itself. Thus, the water can be fed to the press under a low pressure because the water need only be sprayed onto the surface of the band. Splashing is negligible, and the lubrication is effective already at low band speeds.

In order to improve the removal of water collected on the band surface facing the drying felt, a longitudinal grooving or a blind bore 14 can be formed in the surface of the band 2, as shown in FIG. 6.

Figure 7A:
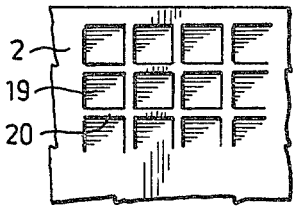
Figure 7B:
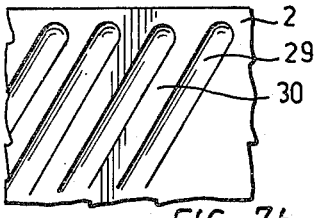
Figure 7C:
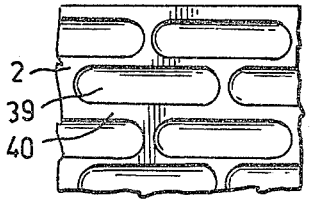
Figure 7D:
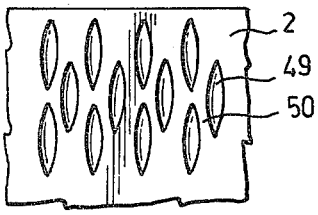
Figure 7E:
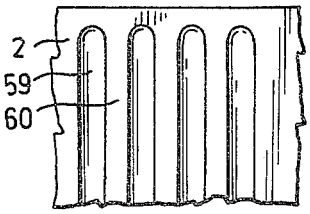

FIGS. 7*a* to 7*e* illustrate alternative embodiments of the recesses to be formed in the band surface. In FIG. 7*a* the recesses 19 are rectangular and in FIG. 7*b* the recesses 29 are formed by obliquely extending grooves. In FIG. 7*c* the recesses 39 are formed by longitudinal grooves which are stepped with respect to each other in the transverse direction of the band. In FIG. 7*d* the recesses 49 are substantially elliptical, and in FIG. 7*e* the recesses 59 are formed by transverse grooves.

The drawings and the description relating thereto are only intended to illustrate the idea of the invention. In its details the press according to the invention may vary considerably within the scope of the claims.

The band 2 can be made of an elastic compressible material only, such as urethanes, rubber, etcs. However, in view of the behaviour and guidability of the band, it is preferred to use in the band additionally a support structure 15, FIGS. 4 and 6, for absorbing longitudinal and transverse forces, in which case the band under the action of the support structure is guided in the same manner as a wire or a felt. The materials for such support structures may comprise nylon, polyester, glass fiber, kevlar, steel, etc. The elastic material must have a high restoring capability. The selection of the material is moreover affected by the lubricant and the material of the sliding shoe.

One preferred embodiment comprises a urethane band reinforced with a nylon fabric when water is used as lubricant and the sliding shoe is provided with a steel surface.

The grooved or blind-bored surface layer 14 facing the felt, as well as alternatively the smooth surface layer of the band, can be of the same material as the opposite surface or of a different elastomer. Similarly, the hardnesses may differ from each other on different surfaces of the band.

The lubricating pattern as well as the water removal pattern on the surfaces of the band can be produced either by means of vulcanizing in a mould or by machining in the vulcanized band.

What I claim is:

1. An extended nip press for a paper machine for removing water from a wet paper, cardboard or similar fibrous or porous web, said press comprising:

a rotating press roll, at least one stationary loading shoe which is parallel with the axis of said press roll and together with said press roll forms an extended press zone, a compressible band which is impermeable to a medium and passes through said press zone between said press roll and said loading shoe, a sliding surface in said loading shoe which is pressed against said band from the opposite side with respect to said press roll, at least one drying felt passing between said press roll and said band for passing a web to be dried through said press zone and for receiving water removed from said web, and means for introducing a lubricating medium in between said band and said sliding surface of said loading shoe, the surface of said band facing said sliding surface of said loading shoe being provided with separated recesses for receiving the lubricating medium, said recesses being entirely closed by the sliding surface of said loading shoe when said recesses are within said press zone, and the press gap between said sliding surface and said press roll being tapered in a wedge shaped manner towards the outlet side of said sliding surface.

2. A press according to claim 1, wherein said recesses in said band are separated by narrow intermediate parts.

3. A press according to claim 1, wherein said surface of said band is over its entire width covered by said recesses.

4. A press according to claim 1, wherein said recesses are cup-shaped.

5. A press according to claim 1, wherein said recesses are rectangular.

6. A press according to claim 1, wherein said recesses are formed by longitudinal, transverse or oblique grooves.

7. A press according to claim 1, wherein the surface of said band opposite with respect to said recesses is longitudinally grooved or blind-bored, over the entire width of said band.

8. A press according to claim 1, wherein the means for introducing a lubricating medium includes means for spraying lubricating medium into said recesses in said band on the inlet side of said sliding surface of said loading shoe.

9. A press according to claim 1 wherein said band is formed of a compressible material such as urethanes or rubber.

10. An extended nip press for a paper machine for removing water from a wet paper, cardboard or similar fibrous or porous web, said press comprising:

a rotating press roll, at least one stationary loading shoe which is parallel with the axis of said press roll and together with said press roll forms an extended press zone having an inlet end and an outlet end, a compressible band which is impermeable to a medium and passes through said press zone between said press roll and said loading shoe, a sliding surface in said loading shoe which is pressed against said band from the opposite side with respect to said press roll, at least one drying felt passing between said press roll and said band for passing a web to be dried through said press zone and for receiving water removed from said web, and means for introducing a lubricating medium in between said band and said sliding surface of said loading shoe, the surface of said band facing said sliding surface of said loading shoe being provided with separated recesses for receiving the lubricating medium, said recesses being entirely closed by the sliding surface of said loading shoe when said recesses are within said press zone, and the press gap between said sliding surface and said press roll being tapered in a wedge shaped manner towards the outlet side of said sliding surface, the volume of said recesses being gradually reduced in the direction from the inlet end of said press zone into the outlet end of said press zone due to the compression of said band at the outlet end so that the lubricating medium is forced between the band and the sliding surface of said shoe.

* * * * *